US005165172A

United States Patent [19]

Weinrauch

[11] Patent Number: 5,165,172

[45] Date of Patent: Nov. 24, 1992

[54] ADJUSTABLE HAIR CLIPPER

[75] Inventor: David Weinrauch, Hilton Head Island, S.C.

[73] Assignee: Pennies From Heaven, Inc., Hilton Head, S.C.

[21] Appl. No.: 821,590

[22] Filed: Jan. 16, 1992

[51] Int. Cl.[5] ..... B26B 19/14

[52] U.S. Cl. ..... 30/199; 30/89; 30/210

[58] Field of Search ..... 30/210, 199, 211, 89; 173/163; 74/385, 417, 423

[56] References Cited

U.S. PATENT DOCUMENTS

| | | | |
|---|---|---|---|
| 333,340 | 12/1885 | Sack | 30/199 |
| 1,427,587 | 8/1922 | Fugitt | 30/199 |
| 2,222,317 | 11/1940 | Martin | 30/199 |
| 2,348,266 | 5/1944 | Selby | 74/385 |
| 2,445,828 | 7/1948 | Heinsohn, Jr. | 74/385 |
| 2,815,834 | 12/1957 | Mall | 74/385 |
| 3,217,409 | 11/1965 | Proffitt | 30/199 |
| 3,597,989 | 8/1971 | Benson | 74/385 |
| 4,522,270 | 6/1985 | Kishi | 173/163 |
| 4,617,736 | 10/1986 | McCrary | 30/89 |
| 4,688,329 | 8/1989 | Oord | 30/89 |

*Primary Examiner*—Douglas D. Watts
*Assistant Examiner*—Hwei-Siu Payer
*Attorney, Agent, or Firm*—Haynes N. Johnson

[57] ABSTRACT

An adjustable hair clipper including an interconnected body and head mounted about a common pivot for rotational movement between the body and the head, the body including a motor with an associated drive shaft, a reciprocating cutter in the head, an operating shaft for actuating the reciprocating means, gears in the body interconnecting the drive shaft and the operating shaft, the gears being pivotable about the common pivot thereby permitting the drive shaft and the operating shaft to rotate relative to one another as the head and the body are rotated relative to one another.

7 Claims, 2 Drawing Sheets 1
3
5
11
13
14
15
21
27
29
31
33
35

ADJUSTABLE HAIR CLIPPER

FIELD OF THE INVENTION

This invention relates to the field of motorized hair clippers. In particular, it relates to hair clippers in which the position of the head relative to the handle can be varied in many degrees of freedom for the convenience of the user.

BRIEF DESCRIPTION OF THE INVENTION

A hair clipper is provided with a motor and a power supply within a handle or body and with a clipping head associated with the handle. The clipping head can be rotated 360° relative to the axis of the handle and be held by detents at positions located every 30°. This is done by having a head joint between the head and the body in which the head is held by interlocking flanges which can pivot about the axis of the power axle leading to the head.

The clipping head can also be rotated for about 180° about an axis transverse to the handle axis. This is done by having a neck joint between the head joint and the body that is pivoted about an axis transverse to the motor axis and by having a gear train within the neck joint which permits such rotation while still transferring motor power to the clipping head.

DETAILED DESCRIPTION OF THE INVENTION

Figures 1, 2, 3, 4:
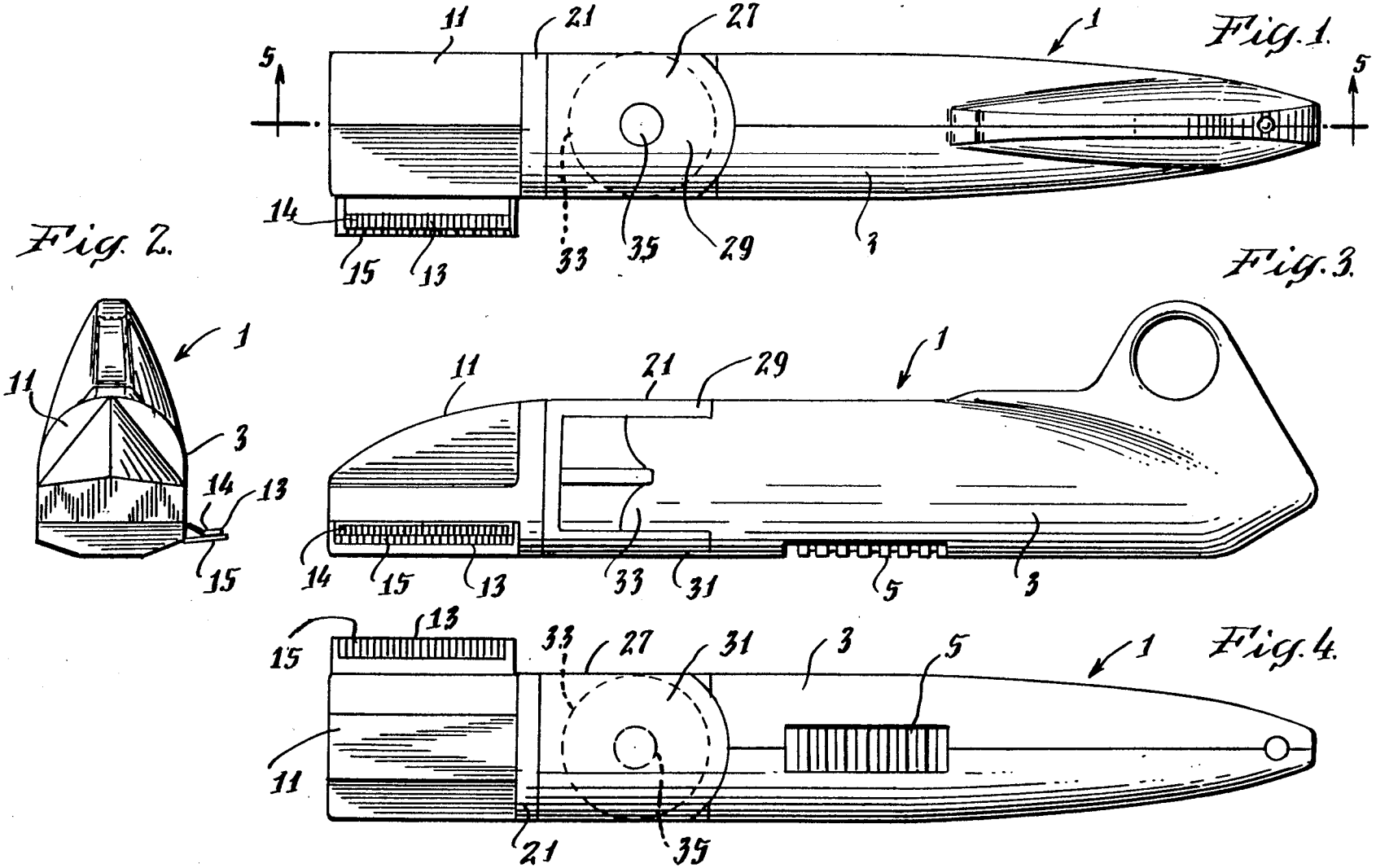
FIG. 1 is a top plan view of my hair clipper.
FIG. 2 is a front elevation thereof.
FIG. 3 is a side elevation thereof.
FIG. 4 is a bottom plan view thereof.
Figure 5:
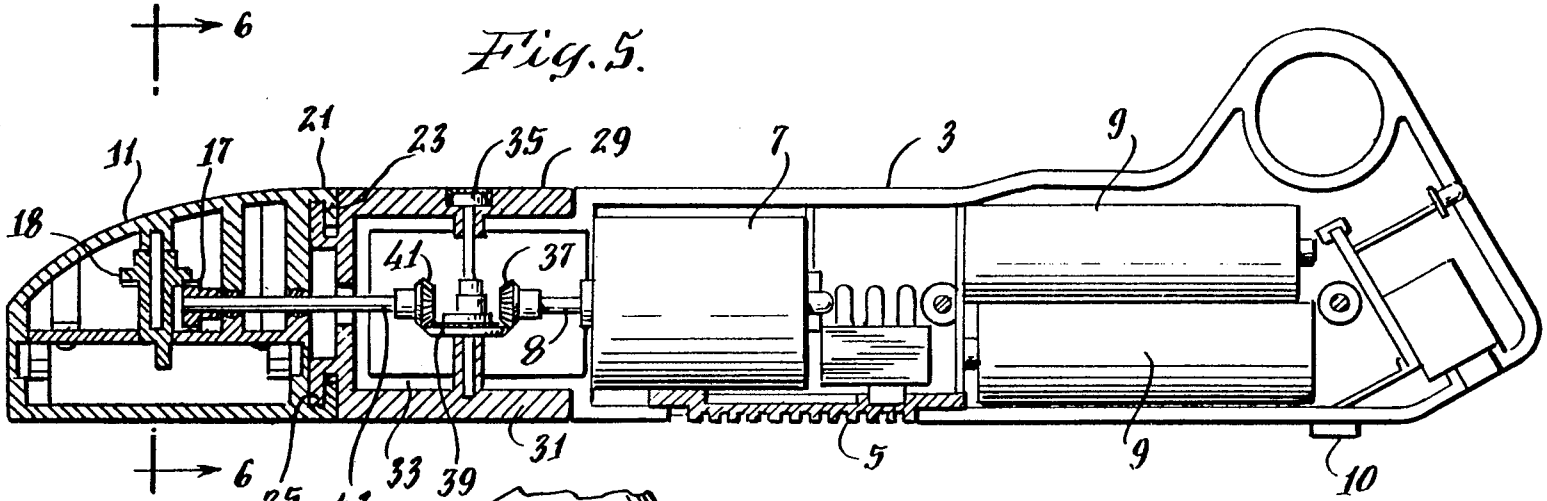
FIG. 5 is a longitudinal section taken on line 5—5 of FIG. 1.

My adjustable hair clipper 1 has a main body or handle portion 3 and a clipper head assembly 11. Between the head assembly 11 and the body 3 are a head joint 21 and a neck joint 27.

Body 3 carries am on-off switch 5 and has within it a motor 7 with motor shaft 8 and batteries 9. If the batteries are rechargeable, it will carry a charging jack 10.

Clipper head assembly 11 carries a cutter assembly 13 having a reciprocating blade (cutter bar) 14 and associated comb 15. Blade 14 is reciprocated in any customary manner, as, for instance, by having crank 19 revolve in crank opening 16 to provide an eccentric motion. Crank 19 is turned by cutter bevel gear 18, which is turned by bevel gear 17 on shaft 43, described below.

Head joint 21 is formed of circular interengaging flanges 23 and 25 which can rotated about the shaft 43, i.e., about the axis of shaft 43.

Neck joint 27 is adapted to pivot about an axis transverse to that of motor shaft 8. It includes unitary head flanges 29 and 31 integral with flange 25 of head joint 21, and flange (frame) 33 integral with body 3. Flanges 29 and 31 mesh with flange 33 and pivot about pivot 35.

Articulation of neck joint 27 requires gearing to permit motor shaft 8 to pivot with respect to head shaft 43. A first bevel gear is on the outer end of motor shaft 8, and a second bevel gear is on the inner end of head shaft 43, These two gears mesh with bevel ring gear 39 which is mounted for rotation about the axis of pivot 35. Regardless of the angular position of shafts 8 and 43 with respect to one another, rotation of first bevel gear 37 (caused by motor 7 rotating shaft 8) will rotate bevel ring gear 39, which in turn will rotate second bevel gear 41, and so head shaft 43.

Accordingly, rotation of motor shaft 8 will serve to rotate head shaft 43, which will turn gears 17 and 18. This will turn crank 19 and cause reciprocation of blade 14. As can be seen, this action will occur regardless of the positions of head joint 21 and neck joint 27.

Figure 8:
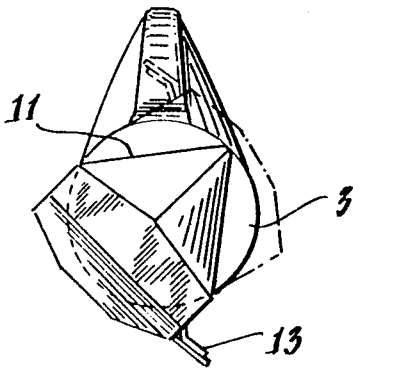
FIG. 8 is front elevation showing how the clipper head assembly can be rotated about the head joint.
Figure 7:
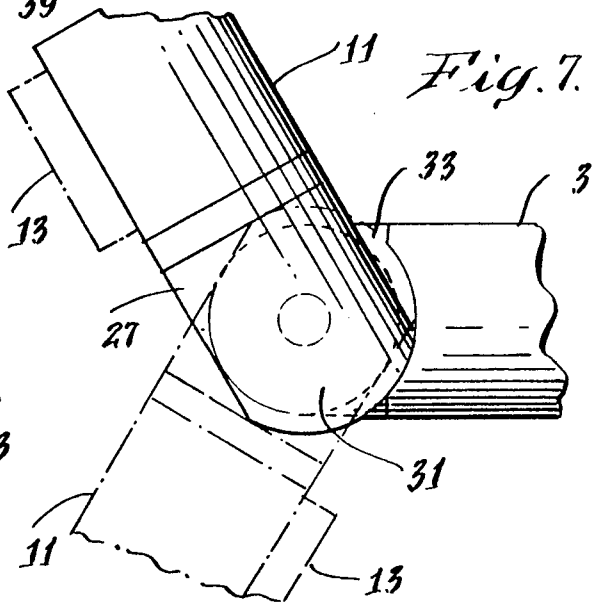
FIG. 7 is a partial top plan view showing how the clipper head assembly can be rotated about the neck joint.
Figure 6:
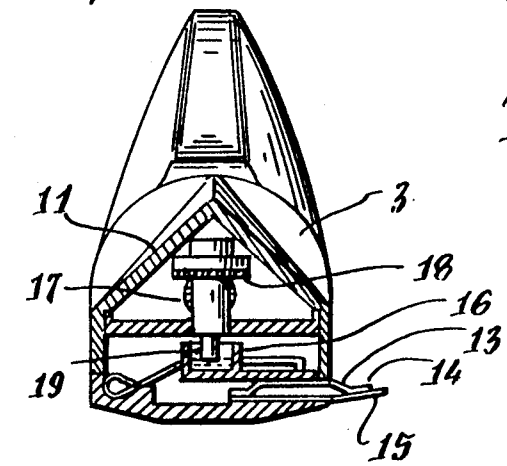
FIG. 6 is a transverse section taken on line 6—6 of FIG. 5.

As stated, head assembly 11 can be rotated up to 180° about an axis transverse to the motor axis. This can be seen in FIG. 7. Likewise, it can be rotated through 360° about the axis of motor shaft 8. This is shown in FIG. 8. (If there has been rotation as in FIG. 7, then the rotation of FIG. 8 would be relative to the head shaft 43).

Thus, a hair clipper has been provided in which the head position can be articulated in numerous degrees of freedom to suit the convenience of the user.

I claim:

1. An adjustable hair clipper including a body portion and a head portion, said body portion having a longitudinal axis, said body portion and said head portion being pivotally secured to one another for relative rotational movement about an axis substantially transverse to said longitudinal axis, a motor in said body portion, said motor having a motor shaft axially aligned with said body portion, a clipping head in said head portion, said clipping head including a blade mounted for reciprocal movement, gear means interconnecting said motor shaft and said clipping head whereby said motor can cause reciprocation of said clipping head, means for rotating said head portion relative to said body portion about said longitudinal axis, and said gear means being pivotable about said longitudinal axis and said axis substantially transverse to said longitudinal axis.

2. An adjustable hair clipper as set forth in claim 1 in which said gear means includes a bevel gear on said motor shaft, a second shaft carrying a second bevel gear, said second shaft being interconnected to said clipping head, and a ring gear interconnecting said bevel gears.

3. An adjustable hair clipper as set forth in claim 1 in which said means for rotating said head portion relative to said body portion about said longitudinal axis includes flanges on said head portion and said body portion, said flanges being interlocked.

4. An adjustable hair clipper including an interconnected body having a longitudinal axis, a head pivotally mounted to said body for rotational movement about an axis transverse to said longitudinal axis, said body including a motor with an associated drive shaft having an axis, said drive shaft running axially of said body in a direction toward said head, a cutter in said head, reciprocating means in said head for reciprocating said cutter, and an operating shaft for actuating said reciprocating means, means for rotating said head and said body relative to one another about said longitudinal axis, gears in said body interconnecting said drive shaft and said operating shaft, said gears being pivotable about said transverse axis and about said axis of said drive shaft thereby permitting said drive shaft and said operating shaft to rotate relative to one another as said head and said body are rotated in two degrees of rotational freedom relative to one another.

5. An adjustable hair clipper as set forth in claim 4 in which said gears include a first bevel gear on said drive shaft and a second bevel gear on said operating shaft and a ring gear interconnecting said first and second bevel gears.

6. An adjustable hair clipper as set forth in claim 4 wherein said means for rotating said head and said body relative to one another about said longitudinal axis includes a first flange on said body and a second flange on said head, said first and second flanges interengaging.

7. An adjustable hair clipper having two degrees of rotational freedom, said hair clipper including a body and a head, a motor and associated motor shaft in said body, a cutter in said head, reciprocating means in said head for reciprocating said cutter, an operating shaft for actuating said reciprocating means, means for rotating said head relative to said body about two different axes, said two different axes being substantially transverse to one another, and gears interconnecting said motor shaft and said operating shaft, said gears being pivotable about said two different axes.

* * * * *